US005673884A

United States Patent [19]

Yemini

[11] Patent Number: 5,673,884

[45] Date of Patent: Oct. 7, 1997

[54] SUCTION-MOUNTED HOLDING DEVICES

[75] Inventor: Zvi Yemini, Tel Aviv, Israel

[73] Assignee: Zag Ltd., Rosh Haayin, Israel

[21] Appl. No.: 565,707

[22] Filed: Nov. 30, 1995

[51] Int. Cl.[6] ..... A47G 1/17

[52] U.S. Cl. ..... 248/205.5; 248/220.21

[58] Field of Search ..... 248/220.21, 205.5, 248/205.6, 205.7, 206.2, 206.3

[56] References Cited

U.S. PATENT DOCUMENTS

| | | | |
|---|---|---|---|
| 3,071,886 | 1/1963 | Stiller | 248/206.3 |
| 4,696,447 | 9/1987 | Strecker | 248/206.3 |
| 4,934,640 | 6/1990 | Bichon | 248/206.2 |
| 4,991,807 | 2/1991 | Radnich | 248/206.3 |
| 5,137,238 | 8/1992 | Hutten | 248/206.3 |
| 5,176,347 | 1/1993 | Rouail | 248/206.2 |
| 5,435,511 | 7/1995 | Hsu | 248/206.3 |
| 5,492,739 | 2/1996 | Thorne et al. | 248/206.2 X |

*Primary Examiner*—Ramon O. Ramirez
*Attorney, Agent, or Firm*—Mark M. Friedman

[57] ABSTRACT

A device attachable to a wall for holding a household item, includes a base for attachment to the wall and a holding element for holding the household item. The base has a suction cup for attachment to the wall, and a support block, with at least one mounting recess, attachable to the suction cup. The holding element has a hook engagable with one of the mounting recesses so that the holding element is readily attachable to, and removable from, the base. The holding element preferably includes an additional suction cup for attachment to a surface of the household item.

11 Claims, 4 Drawing Sheets

SUCTION-MOUNTED HOLDING DEVICES

FIELD AND BACKGROUND OF THE INVENTION

The present invention relates to household fixtures and, in particular, to suction-mounted devices for holding household items.

It is known to use suction cups for affixing hooks or the like to smooth vertical surfaces such as tiled walls. The suction cups are generally made of silicone rubber or of natural or synthetic polymer materials with similar properties thereto.

Suction-mounted hooks are generally of limited use, being suited to holding only those items designed to be hung, such as by a loop.

There is therefore a need for suction-mounted devices for holding a wider range of items.

SUMMARY OF THE INVENTION

The present invention is of suction-mounted devices for holding household items.

According to the teachings of the present invention there is provided, a device attachable to a wall for holding a household item, the device comprising: (a) a base including: (i) a primary suction cup for attaching to the wall, and (ii) a support block attached to the suction cup, the support block having at least one mounting recess; and (b) a holding element for holding the household item, the holding element having a hook engagable with one of the at least one mounting recess such that the holding element is readily attachable to, and removable from, the base.

According to a further feature of the present invention, the holding element includes a secondary suction cup for attachment to a surface of the household item.

According to a further feature of the present invention, the force required to remove the secondary suction cup from the surface of the household item is greater than the force required to disengage the hook from the at least one mounting recess such that the holding element remains attached to the household item when the household item is removed from the base.

According to a further feature of the present invention, the support block is an elongated support bar, the base also including an additional primary suction cup attached to the wall at a position removed from the aforementioned primary suction cup, the support bar being attached to both the primary suction cups.

According to a further feature of the present invention, the at least one mounting recess is a plurality of mounting recesses spaced along the support bar.

According to a further feature of the present invention, the holding element includes a ledge for supporting the household item, and an additional hook, the additional hook and the aforementioned hook each engaging one of the plurality of mounting recesses so as to support the ledge.

According to a further feature of the present invention, the at least one recess is formed as a substantially vertical socket.

According to a further feature of the present invention, the support block has an upper edge, the at least one recess being formed as a groove in the upper edge.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of suction-mounted devices for holding household items.

The principles and operation of devices according to the present invention may be better understood with reference to the drawings and the accompanying description.

Figure 1:
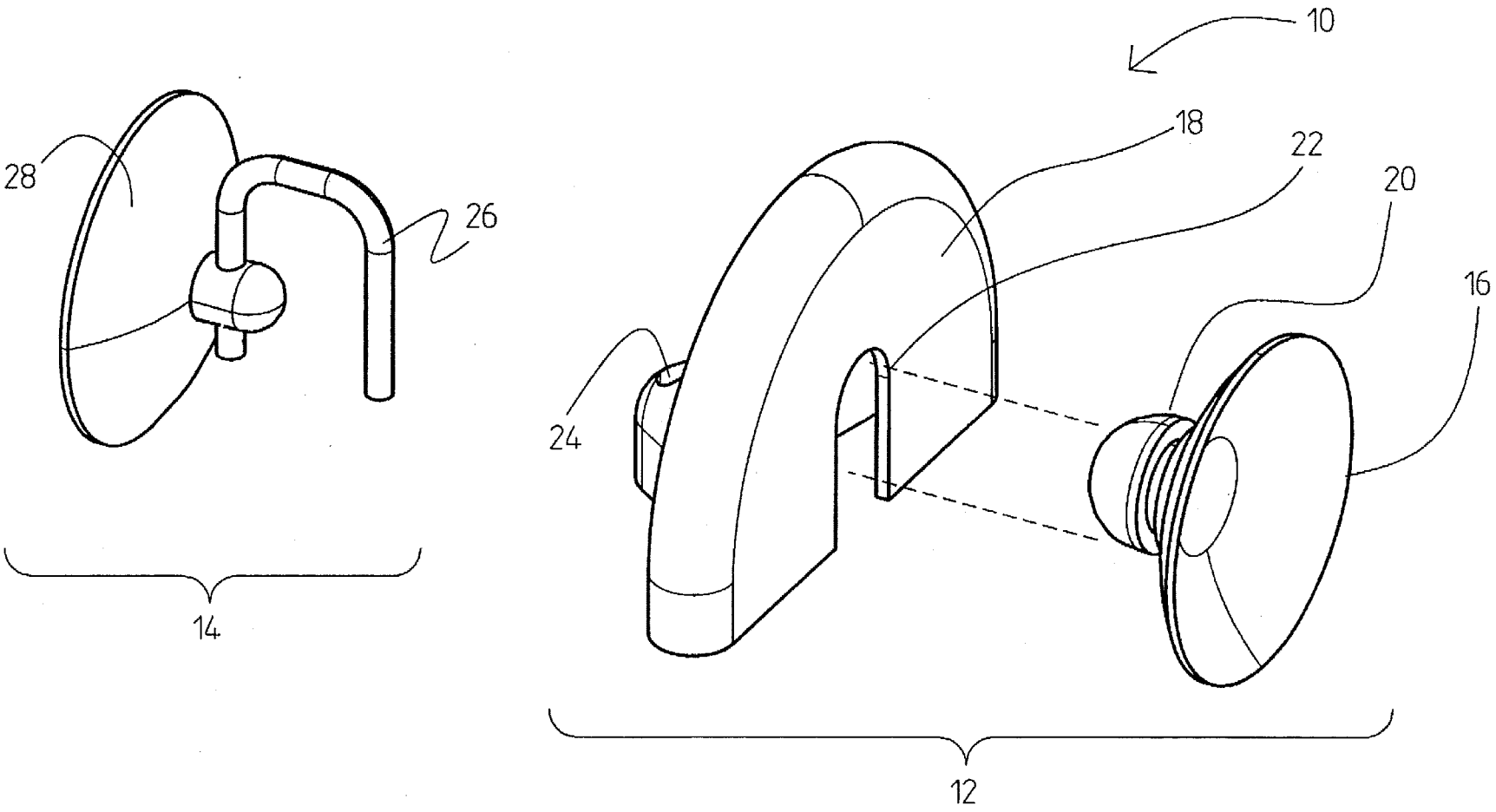
FIG. 1 is an exploded perspective view of a first embodiment of a suction-mounted holding device, constructed and operative according to the teachings of the present invention.
Figure 2:
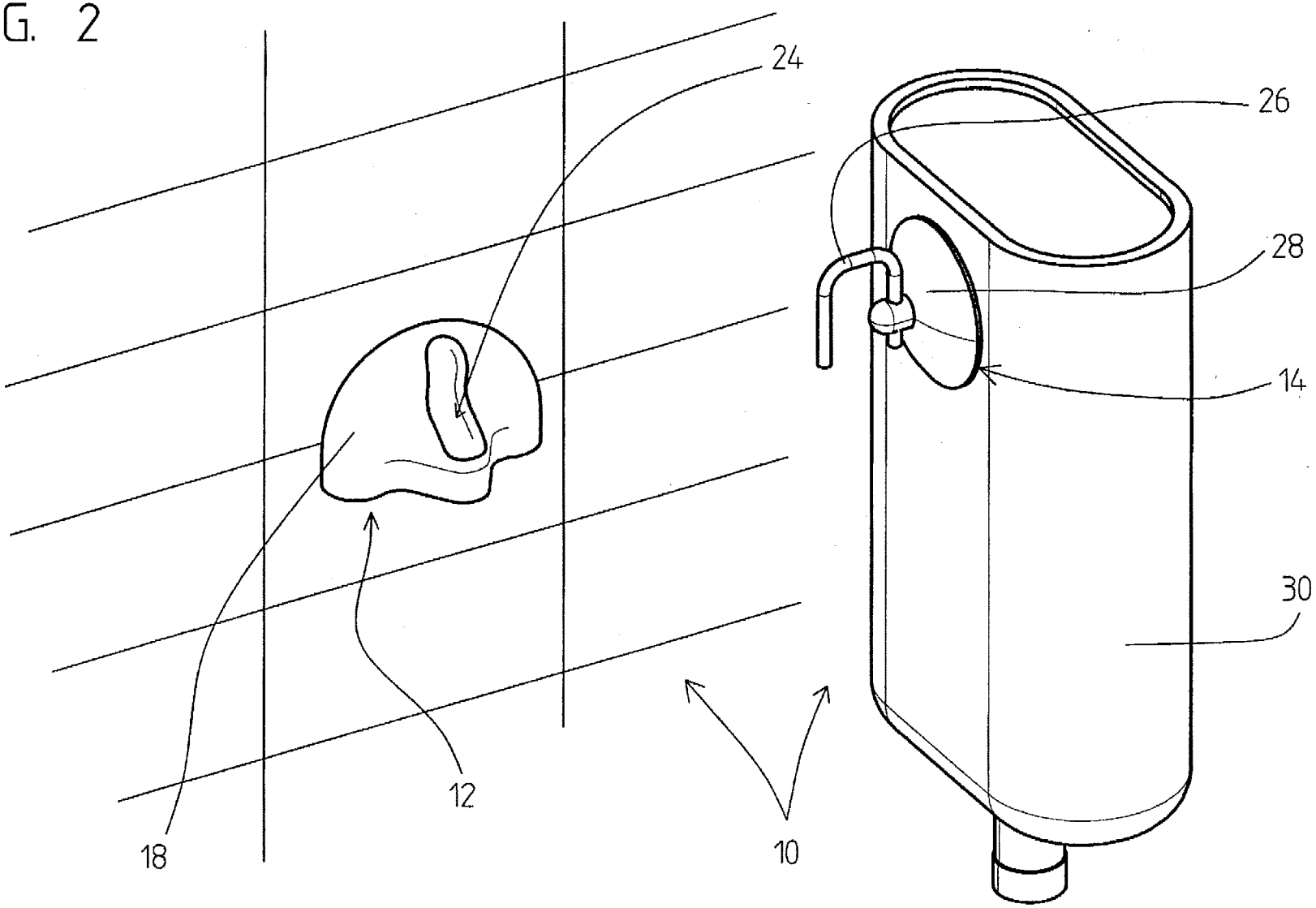
FIG. 2 is a perspective view of the device of FIG. 1 used to hold a flexible bottle.

Referring now to the drawings, FIGS. 1 and 2 show a first embodiment of a suction-mounted holding device, generally designated 10, constructed and operative according to the teachings of the present invention.

Generally speaking, device 10 is made up of a base 12 which is semipermanently attached to a wall, and a holding element 14 which is readily attachable to, and removable from, base 12. This configuration allows holding element 14 to be attached firmly to a household item so that the household item becomes temporarily adapted for storage in a manner convenient for remove/replace type usage. Device 10 is therefore ideal for holding a wide range of household items which are normally used for brief periods and then restored.

The term "semi-permanent" in this context refers to any time frame significantly longer than the typical time between consecutive usages of the items being stored. Since device 10 is suction mounted, it may of course be removed without leaving any trace whenever it is no longer required.

The term "household item" is used herein, in the specification and claims, to refer to any of a wide range of consumer products and other disposable and non-disposable items in common domestic use. Examples include, but are not limited to, toiletries, cosmetics and cleaning materials.

Although the present invention is described, by way of example, for attachment to a wall, it will be appreciated that it may equally be affixed to any smooth surface adjacent to the desired storage location. Examples include, but are not limited to, wood, melamine and ceramic surfaces, and glass mirrors.

Turning now to the features of device 10 in more detail, base 12 includes a suction cup 16 and a support block 18. Suction cup 16, which is made from any suitable material, is attachable to the wall and preferably features a lug 20. Support block 18 has a slot 22 to receive lug 20 for attachment of support block 18 to suction cup 16. Support block 18 also features a recess in the form of a socket or bore 24 extending generally vertically through support block 18.

Holding element 14 includes a hook 26 which is engagable with socket 24. Hook 26 is attached to a suction cup 28 which is used to attach holding element 14 to the surface of a household item. Suction cup 28 achieves an effective attachment to any generally smooth non-porous surface, whether flat or curved. The suction provided is typically sufficient to support weights in excess of 2–3 kg force, and may therefore be used for most liquid-filled bottles and other heavy household items. It should be noted that "hook" 26 is formed to complement the form of socket 24 and does not necessarily have the turned-back-on-itself form often associated with the term "hook". Thus, any form effective for engaging socket 24 may be used.

As already mentioned, it is a particular feature of this embodiment of the present invention that holding element 14 is readily attachable to, and removable from, base 12. To this end, the diameter of hook 26 is slightly smaller than that of socket 24 and hook 26 is shaped smoothly so as to fit easily into socket 24. These features ensure that the force required to remove suction cup 28 from the surface of a household item to which it is attached will generally be greater than the force required to disengage hook 26 from socket 24. Holding element 14 therefore remains attached to the household item when the household item is removed from base 12 for use.

FIG. 2 illustrates a particular advantage of device 10 when used for holding a flexible bottle 30 containing a viscous fluid, such as shampoo. By attaching suction cup 28 of holding element 14 near the bottom of flexible bottle 30, device 10 allows storage of bottle 30 hanging in an inverted position. In this position, gravitational force acts during storage to ensure that the viscous fluid collects near the opening of bottle 30, thus being instantly available for use.

Figure 3:
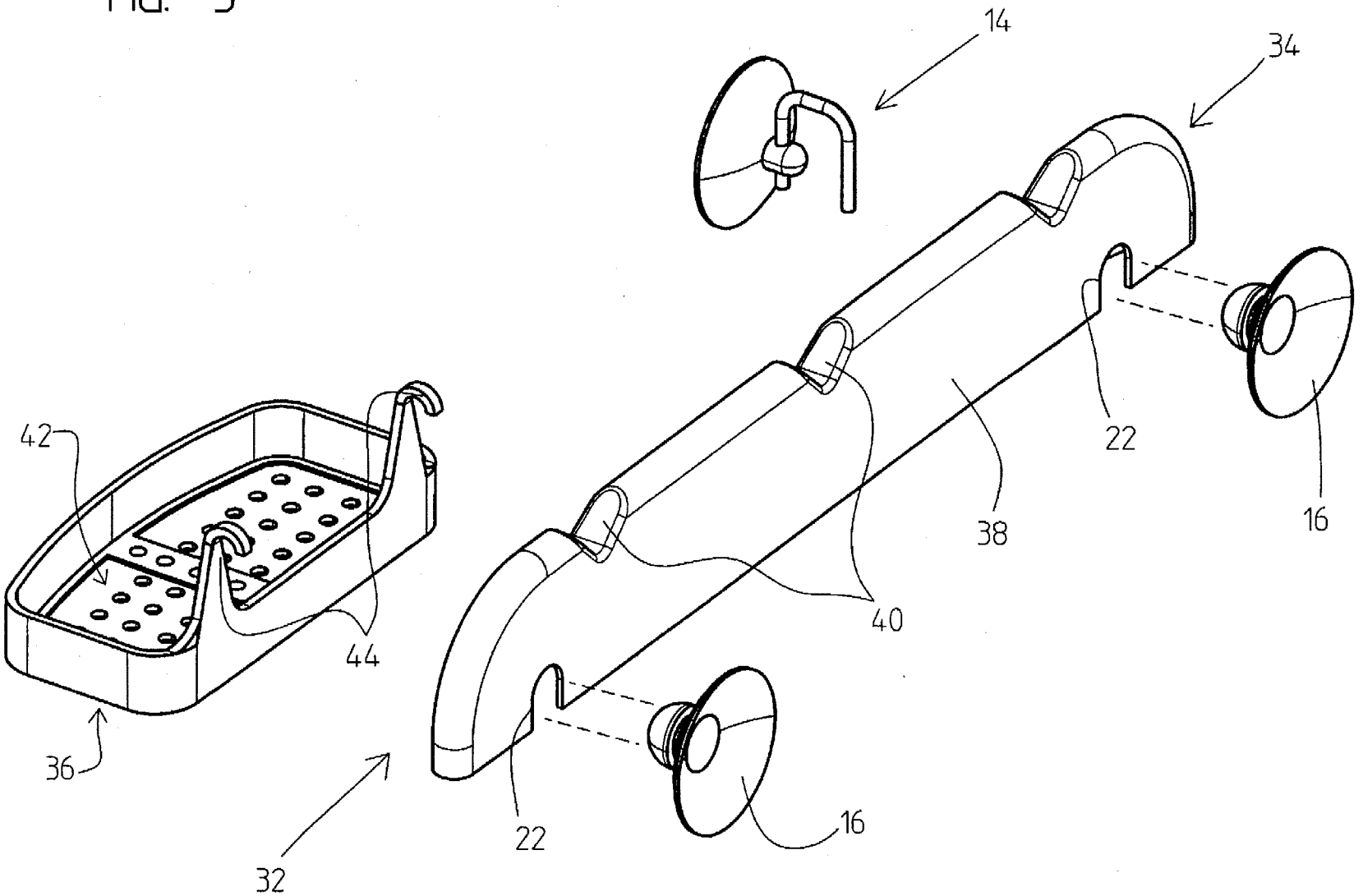
FIG. 3 is an exploded perspective view of a second embodiment of a suction-mounted holding device, constructed and operative according to the teachings of the present invention.
Figure 4:
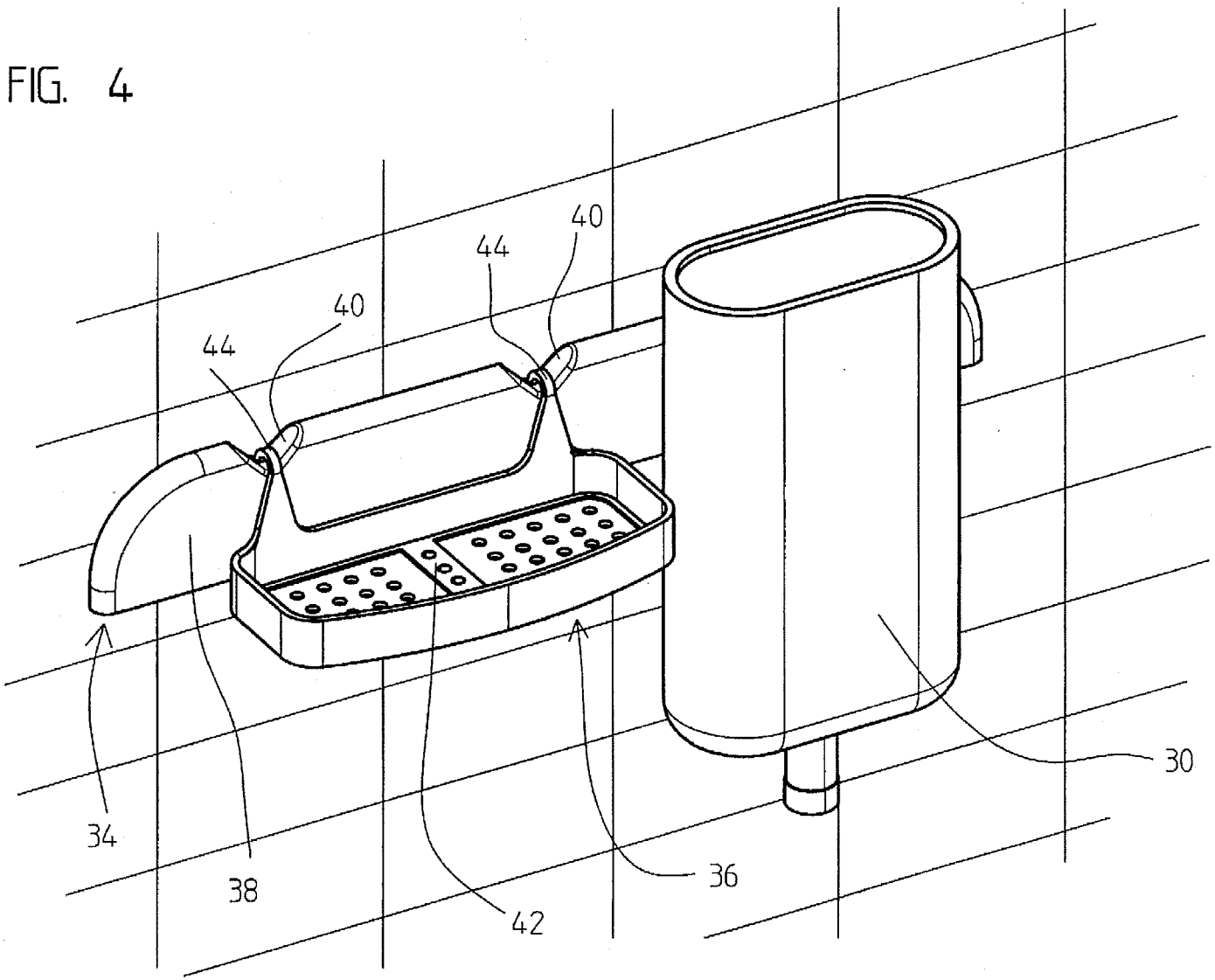
FIG. 4 is a perspective view of the device of FIG. 3 in use.

With reference now to FIGS. 3 and 4, a second embodiment of a suction-mounted holding device, generally designated 32, constructed and operative according to the teachings of the present invention, will be described. Device 32 is conceptually similar to device 10, but is formed with an elongated base 34. This enables device 32 to provide a ledge element 36 for supporting one or more household items in addition to, or as an alternative to, a number of holding members 14.

Thus, elongated base 34 includes a support block 38, here referred to as elongated support bar 38, which features two spaced-apart slots 22 for receiving two suction cups 16 which are used to fix support bar 38 to a wall in a generally horizontally-extending manner. Elongated support bar 38 also features several recesses in the form of grooves 40 in the upper edge of support bar 38 for receiving holding elements. Grooves 40 may be U-shaped, V-shaped or rectangular in form, or any variations thereof.

As already mentioned, the holding elements for use with this embodiment of the present invention may be either a ledge element 36, or holding members 14 described above, or a combination of these two types. Ledge element 36 features a ledge 42 which is supported at two or more points by hook brackets 44 which engage grooves 40. Ledge 42 may be adapted to any of a number of different uses for which it is intended, for example, with drainage holes for use as a soap dish as illustrated.

It will be appreciated that the above descriptions are intended only to serve as examples, and that many other embodiments are possible within the spirit and the scope of the present invention.

What is claimed is:

1. A device attachable to a wait for holding a household item, the device comprising:

(a) a base including:

(i) a primary suction cup for aching to the wall, and (ii) a support block attached to said suction cup, said support block having at least one mounting recess formed as a substantially vertical socket; and (b) a holding element for holding the household item, said holding element having a hook engagable with one of said at least one mounting recess such that said holding element is readily attachable to, and removable from, said base.

2. The device of claim 1, the household item having a surface, wherein said holding element includes a secondary suction cup for attachment to the surface of the household item.

3. The device of claim 2, wherein the force required to remove said secondary suction cup from the surface of the household item is greater than the force required to disengage said hook from said at least one mounting recess such that said holding element remains attached to the household item when the household item is removed from said base.

4. The device of claim 1, wherein said support block is an elongated support bar, said base also including an additional primary suction cup attached to the wall at a position removed from the aforementioned primary suction cup, said support bar being attached to both said primary suction cups.

5. The device of claim 4, wherein said at least one mounting recess is a plurality of mounting recesses spaced along said support bar.

6. The device of claim 5, wherein said holding element includes a ledge for supporting the household item, and an additional hook, said additional hook and the aforementioned hook each engaging one of said plurality of mounting recesses so as to support said ledge.

7. A device attachable to a wall for holding a household item, the device comprising:

(a) a base including:

(i) an elongated support bar having a plurality of mounting recesses spaced along said support bar, (ii) a first primary suction cup attached to said support bar, and (iii) a second primary suction cup attached to said support bar at a position removed from said first primary suction cup, said first and second primary suction cups being arranged for attaching said support bar to the wall; and (b) a holding element for holding the household item, said holding element having a hook engagable with one of said plurality of mounting recesses such that said holding element is readily attachable to, and removable from, said base.

8. The device of claim 7, the household item having a surface, wherein said holding element includes a secondary suction cup for attachment to the surface of the household item.

9. The device of claim 8, wherein the force required to remove said secondary suction cup from the surface of the household item is greater than the force required to disengage said hook from said one of said plurality of mounting recesses such that said holding element remains attached to the household item when the household item is removed from said base.

10. The device of claim 7, wherein said holding element includes a ledge for supporting the household item, and an additional hook, said additional hook and the aforementioned hook each engaging one of said plurality of mounting recesses so as to support said ledge.

11. The device of claim 7, wherein said support bar has an upper edge, said plurality of recesses being formed as grooves in said upper edge.

* * * * *